US006786767B1

(12) United States Patent
Fuks et al.

(10) Patent No.: US 6,786,767 B1
(45) **Date of Patent: *Sep. 7, 2004**

(54) CONNECTOR FOR COAXIAL CABLE

(75) Inventors: Rudolf Fuks, Millburn, NJ (US); Stephen J. Toma, New York, NY (US); George Georghiou, Fairview, NJ (US); Donald P. Durett, Bayview, NY (US)

(73) Assignee: Astrolab, Inc., Warren, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 327 days.

(21) Appl. No.: 09/604,141

(22) Filed: Jun. 27, 2000

(51) Int. Cl.[7] ..... H01R 9/05
(52) U.S. Cl. ..... 439/578
(58) Field of Search ..... 439/578, 584

(56) References Cited

U.S. PATENT DOCUMENTS

| | | | | |
|---|---|---|---|---|
| 4,545,637 A | * | 10/1985 | Bosshard et al. | 439/578 |
| 4,672,342 A | * | 6/1987 | Gartzke | 439/578 |
| 4,743,327 A | * | 5/1988 | DeHaan et al. | 156/272.6 |
| 4,753,611 A | * | 6/1988 | Kobler | 439/578 |
| 5,214,243 A | * | 5/1993 | Johnson | 439/578 |
| 5,607,325 A | | 3/1997 | Toma | 439/578 |
| 5,796,315 A | * | 8/1998 | Gordon et al. | 439/578 |
| 5,830,010 A | * | 11/1998 | Miskin et al. | 439/578 |
| 5,928,032 A | * | 7/1999 | Dreesen | 439/578 |
| 5,945,634 A | * | 8/1999 | Shimirak et al. | 439/578 |

OTHER PUBLICATIONS

Epoxy, 2pgs.; htpp;//me.mit.edu/2.01/Taxonomy/Characteristics/Epoxy.html.

Section 4.2:Epoxy Adhesives, p. 7; The Loctite Design Guide for Bonding Metals, vol. 3.

Bonding:Epoxy & Urethane Adhesives, p. 12.

Custom Electronics, Inc., General Epoxy Information . . . , 2 pgs; http://www.customelec.com/epoxy.htm.

BJB Enterprises, Inc.–Epoxy Resin Systems, 2 pgs. Http://www.bjbenterprises.com/products/product7.html.

RTG's High performance general purpose TIGA epoxy adhesives; Resin Technology group,LLC. Custom Formulations and Innovative Solutions to Meet Your Application Requirements; http://www.resintechgroup.com/Tiga.html.

Epoxy Technology: Products–Thermally Conductive, Adhering to customer demands large and small, 2pgs.; http;//www.epotek.com/thermally_conductive.html.

Epoxy technolgy: Products–Electrically Conductive, Adhering to customer demands large and small, 2pgs.; http://www.epotek.com/electrically conductive.html.

Epoxy Technology: Products–Optical, We've got you connected coming and going; 2pgs; http://www.epotek.com/optical.html.

Epoxy Technology: Products–Solder Replace, Soldering SMT packages is not so hot; http://www.epotek.com/solder replace.html.

AREMCO High Performance Epoxies; Technical Bulletin A7; AREMCO Products, Inc., Valley Cottage, NY.

High Performance Epoxies.

* cited by examiner

*Primary Examiner*—P. Austin Bradley
*Assistant Examiner*—Felix O. Figueroa
(74) *Attorney, Agent, or Firm*—Jeffrey M. Kaden; Gottlieb, Rackman & Reisman, P.C.

(57) ABSTRACT

An electrical connector for terminating flexible coaxial cable is provided. The flexible coaxial cable includes an inner conductor, an intermediate dielectric, an outer flexible braided intermediate dielectric and an outer insulator. A bored interface body has a first end with a first bore of relatively large inner diameter and a second end with a second bore of relatively smaller inner diameter than the first bore. A coupling member is located proximate to the interface body. An annular locking member having an inner diameter sized to receive the coaxial cable therein and an outer diameter sized to fit tightly within the first bore of the interface body. The locking member is bonded to the coaxial cable, which, in construction, is pre-conditioned to accept a bonding agent such as an epoxy resin.

27 Claims, 4 Drawing Sheets

CONNECTOR FOR COAXIAL CABLE

BACKGROUND OF THE INVENTION

This invention is directed generally to a connector for flexible coaxial cable and, in particular, to an electrical connector for terminating the end of flexible coaxial cable that is relatively small in size, that does not require any crimping and which has increased pull strength and improved anti-rotational captivation.

Coaxial connectors have taken many forms in the prior art as exemplified by U.S. Pat. No. 4,408,821 (Forney, Jr.) which is directed to a connector for semi-rigid coaxial cable. The connector for semi-rigid coaxial cable of Forney, Jr. is directed to a connector that does not require crimping. It uses a grip ring having multiple spline fingers extending therefrom and grooves on its inner surface, and a bored tubular shell member having a contoured internal diameter to accept the cable and the grip ring. When the grip ring and cable are inserted into the tubular body, the spline fingers resiliently deflect inwardly along the shell member contour, and embed into the outer semi-rigid cable sheath. The connector system can not provide termination for flexible cables because they do not include a semi-rigid sheath for the spline fingers to embed into.

U.S. Pat. No. 5,186,655 (Glenday, et al.) is directed to an RF connector. This connector locks in place by having a sleeve that is insertable between the outer conductor of a coaxial cable and the inner dielectric, such that the jacket and the outer conductor are deformed. After the sleeve is inserted, a coupling nut is then moved into place and frictionally engages the sleeve. This invention suffers deficiencies in the manner that the jacket electronically connects with the outer conductor, and the way that the coupling nut is coupled to the sleeve. The Glenday, et al. invention can not provide electrical performance for microwave frequencies because the method of deforming the plastic jacket on the outer conductor does not provide sufficient electrical contact at microwave frequencies. Therefore, this connector can not be used for microwave transmission, and is useful only for frequencies up to a few hundred MHz (CATV).

U.S. Pat. No. 5,607,325, incorporated herein by reference, describes an electrical connector for terminating flexible coaxial cable. The flexible cable includes an inner conductor, an intermediate dielectric, an outer flexible braided conductor and an outer insulator. A bored interface body has a first end with a first bore of relatively large inner diameter, a second end with a second bore of relatively smaller inner diameter than the first bore, and a third bore located therebetween of relatively smaller inner diameter than the second bore. A coupling member is located proximate to the interface body. An annular locking member having an inner diameter sized to receive the coaxial cable therein, an outer diameter sized to fit tightly within the first bore of the interface body, a first end having a collar and a second end having a plurality of ribs disposed proximate thereto is provided. This configuration allows for insertion of the second end of the locking member within the first bore of the interface body, so that the ribs of the locking member frictionally engage the inner wall of the first bore to lock the locking member to the interface body.

A typical connector for flexible microwave coaxial cable uses a ferrule to captivate the connector body to the cable jacket by friction. This crimp attachment improves the pull strength and anti-rotational (torque) captivation. Torque creates a potential failure for an coaxial cable assembly.

Captivation of the cable jacket to the connector body is critical for many applications. Even highly flexible coaxial cable assemblies cannot withstand a large amount of torque. Pull strength is important for the mechanical integrity of a cable assembly. Additionally, the electrical performance of the cable assembly relies on mechanical captivation, particularly at high frequencies. Axial force applied to the cable can change the connector dimensions in the interface area, i.e., the contact and dielectric positions relative to the reference plane of the connector. This difference is small, usually about one or two millinches. It does not make a significant difference in the electrical performance of connector at the low frequencies; however, at frequencies higher than 18 GHz, the dimensional difference in the connector interface area has a crucial effect on electrical performance. Modern telecommunications systems need extended frequencies due to the high volume of information that is transmitted. Internet, Wireless, Space and Defense systems are growing at an exponential rate, creating great demands for more bandwidth.

The operational frequency limit of today's typical coaxial assemblies is very high compared to the requirements of only a few years ago. Today, millimeter wave components (frequencies higher than 30 GHz) are common in the marketplace. Some manufacturers have 40 GHz coaxial cables in stock. Currently the highest operational frequency of a flexible coaxial assembly is approximately 65 GHz. In the near future, this limit is expected to extend up to 100 GHz.

For high frequency assemblies, the milliinch difference in the interface dimensions is significant, making the pull strength captivation very important. The best mechanical captivation and electrical performance method is a solder/crimp connector attachment, as shown in FIG. 1. The connector attachment is defined by a connector 210 which includes a connector or interface body 218 and a coaxial cable 232 formed with an outer insulator or jacket 224, an outer braided conductor 226, an inner insulator (not shown), and an inner conductor 230. Connector body 218 is substantially annular and includes a first end 270 and a second end 272. First end 270 is proximate a first annular body section 274 and second end 272 is located proximate a second annular body section 276 having a longer external diameter than first body section 274. Connector 210 also includes an annular extending crimped ferrule 278. As shown, outer conductor 226 is soldered to connector 218 by means of solder material 225. Outer conductor 226 is crimped, as shown at 279, in order to capture first body section 274 of connector body 218.

A connector with a crimp ferrule has fair axial and anti-torque captivation, but the crimp ferrule adds significant length. Soldering the cable outer conductor to the connector body provides a rigid bond between the connector body and the cable, but the solder joint is subject to cracking during vibration, flexure or thermal cycling, which may cause electrical and/or mechanical failure of the cable assembly. The soldering process also subjects the cable dielectric to excessive heat, which may cause the dielectric to expand, requiring retrimming of the interface dimensions. Crimp and solder crimp attachments have approximately the same length. The connector of U.S. Pat. No. 5,607,325, discussed above, is short in length, which is very convenient for customers. However, it cannot handle the high pull force that some customers require (sometimes more than 20 pounds without any electrical degradation) and it has limited anti-rotational captivation (typically only ±15° for one cycle).

Accordingly, it is desirable to provide a connector for flexible coaxial cable that provides improved pull strength and improved anti-rotational captivation.

SUMMARY OF THE INVENTION

Generally speaking, in accordance with the present invention, an electrical connector for terminating flexible coaxial cable is provided. The connector includes a bored interface body having a first end with a first bore of relatively large inner diameter, a second end with a second bore of relatively smaller inner diameter than the first bore, and a third bore located therebetween of relatively smaller inner diameter than the second bore. A coupling member is located proximate the interface body and an annular locking member having an inner diameter sized to receive the coaxial cable therein is provided. The locking member having an inner diameter sized to receive the coaxial cable therein is provided. The locking member has an outer diameter sized to fit tightly within the first bore of the interface body, a first end having a collar and a second end having a plurality of ribs disposed proximate thereto, so that upon insertion of the second end of the locking member within the first bore of the interface body, the ribs frictionally engage the inner wall of the first bore to lock the locking member to the interface body.

Accordingly, by inserting the locking member within the interface body, a single coupling is formed. The coupling member is rotatably coupled to the interface body between the collar of the locking member and an enlarged portion of the interface body.

The flexible coaxial cable includes an inner conductor, an intermediate dielectric, an outer flexible braided conductor and an outer insulator. The outer insulator is stripped away from the end of the connector, and the outer flexible braided conductor is fanned-out, so that when the locking member is inserted into the interface body, the second end of the locking member bears against the fanned-out flexible conductor and pushes it against an internal wall of the interface body to thereby lock the coaxial cable to the interface body.

Preferably, the outer insulator of the coaxial cable is pre-conditioned for bonding to the locking member. As a result, pull strength is increased to 30 to 40 pounds and anti-rotational captivation is improved to ±90° for multiple cycles. Furthermore, bonding of the cable to the locking member prevents moisture from migrating to the junction therebetween, thus extending the temperature range in which the cable can be used to between −55° C. and +125° C.

It is an object of the present invention to provide a connector for flexible coaxial cable that has a small profile and does not require crimping.

Another object of the present invention is to provide a connector for flexible coaxial cable that provides a transmission medium from direct current to millimeter waves.

Yet another object of the present invention is to provide flexible coaxial cable that provides the electrical product designer with maximum flexibility.

A further object of the present invention is to provide a connector for coaxial cable that does not require soldering of the outer conductor which may cause dielectric damage; however, the center conductor should be soldered.

Still another object of the invention is to provide a coaxial cable with a profile that is lower than the standard right angle connectors designed for flexible coaxial cable.

Yet a further object of the invention is to provide a connector for flexible coaxial cable having improved pull strength and improved anti-rotational captivation.

Still other objects and advantages of the invention will in part be obvious and will in part be apparent from the specification and drawings.

Accordingly, the invention comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

The drawings generally depict an electrical connector for flexible coaxial cable, and specifically a low-profile connector that does not require soldering or crimping of the outer conductor, and operates at frequencies approaching millimeter wave service.

In a preferred embodiment of the present invention, the connector is formed with an interface body that is configured to receive the coaxial cable therethrough, along with a bushing and bonding agent that locks the interface body to the coaxial cable.

Figure 2:
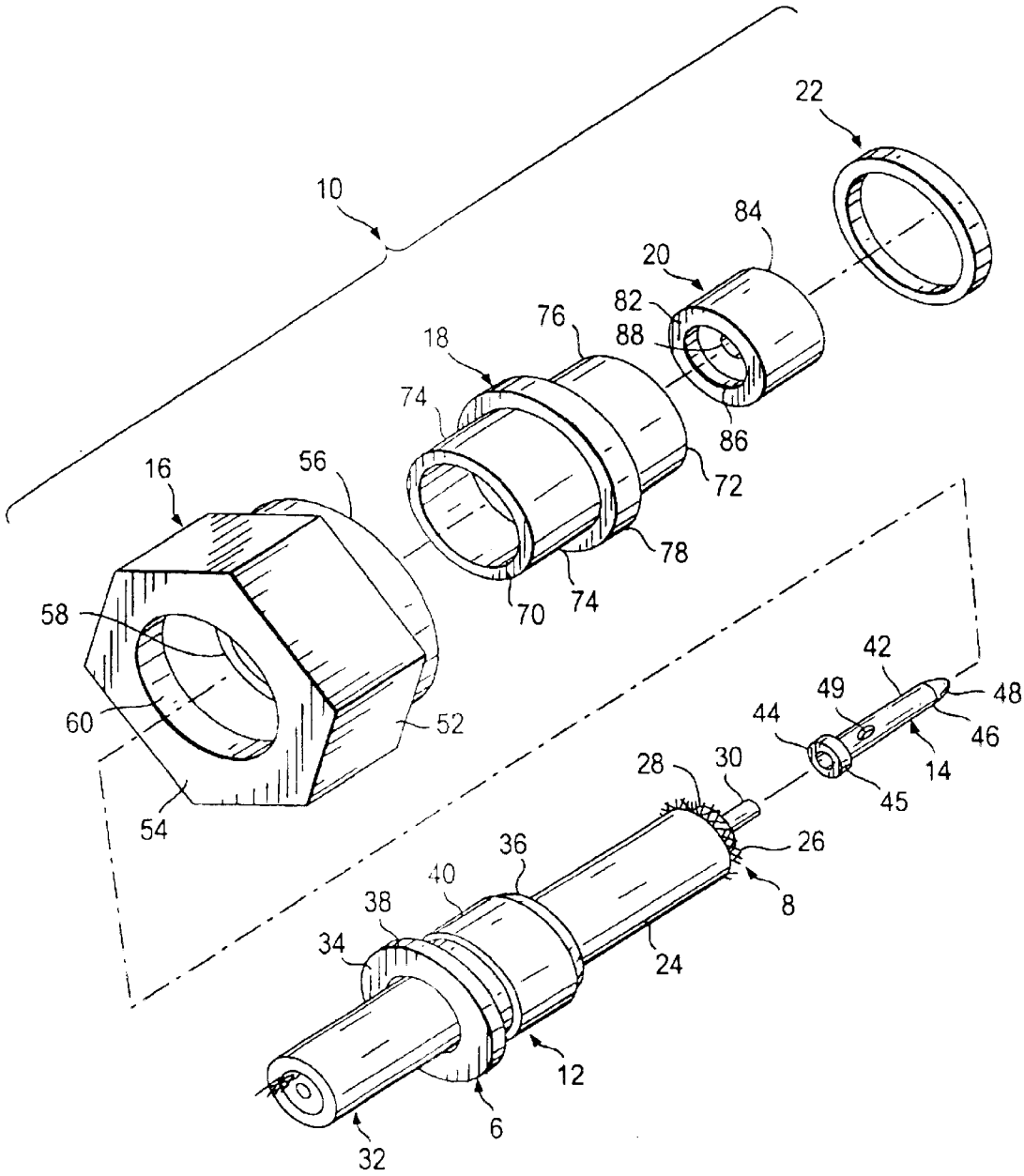
FIG. 2 is an exploded prospective view of the end of a coaxial cable with a connector of the first embodiment of the present invention.
Figure 3:
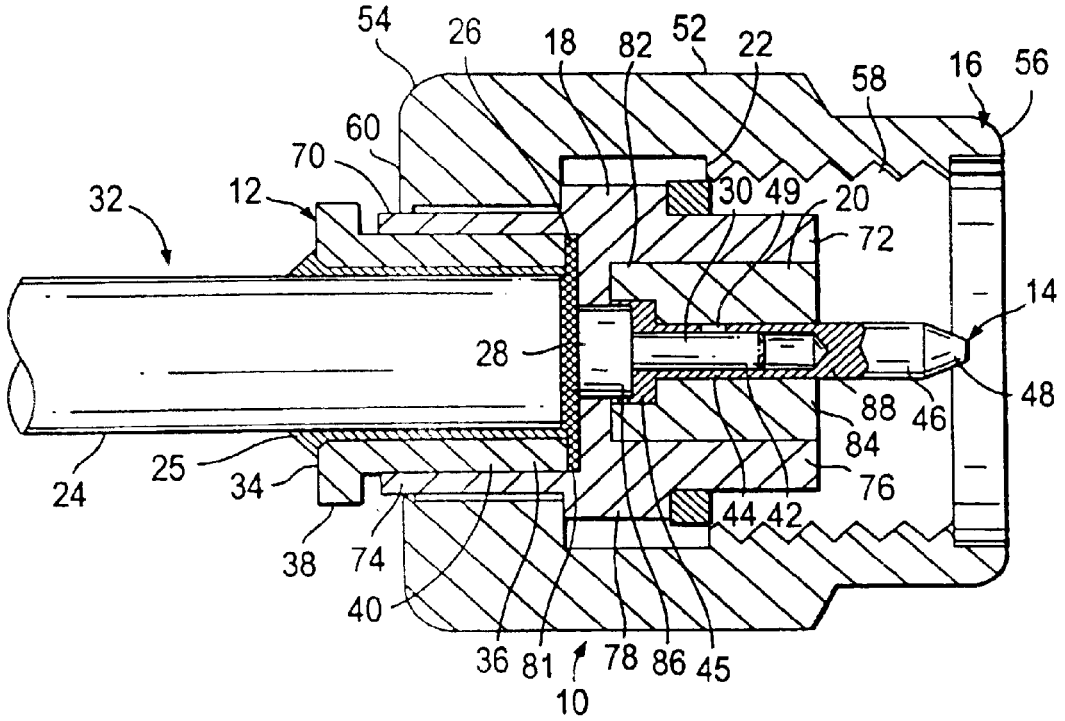
FIG. 3 is a fully-assembled cross-sectional view in accordance with a first embodiment of the present invention.

Reference is now made to FIGS. 2 and 3 of the drawings wherein a first embodiment of an electrical connector, generally indicated at 10 and constructed in accordance with a preferred embodiment of the invention, is depicted. Connector 10 includes a bushing or locking member 12, a male contact 14, a coupling nut 16, an interface body 18, an inner insulator 20 and a gasket seal 22. Coaxial cable 32 is formed with an outer insulator 24 preconditioned to accept a bonding agent 25, an outer braided conductor 26, an inner insulator 28 and an inner conductor 30.

Bushing or locking member 12 has a continuous inner surface sized to tightly receive a bonding agent 25 disposed along the outer insulator 24 of coaxial cable 32. Bushing 12 includes a first end 34 and a second end 36. A radially-extending collar 38 extends from the first end 34 of bushing 12, and a plurality of axially-extending ribs 40 are located intermediate first end 34 and second end 36. Ribs 40 extend radially outward from the outer surface of bushing 12.

Male contact 14 includes an essentially annular body 42, a first end 44 and a second end 46. A radially outwardly-extending collar 45 is located on first end 44. Second end 46 of male contact 14 terminates in a cone-shaped member 48. Male contact 14 is inserted over inner conductor 30, and may be soldered in place if desired through bore 49 formed in annular body 42. Alternatively, it may be loosely fitted over inner conductor 30, and after assembly of interface body 18, when inner insulator 20 is placed within interface body 18, inner insulator 20 bears against collar 45 and locks male contact 14 in place.

Coupling nut 16 includes a first end 54 and a second end 56. The first end includes a hexagonal outer surface 52, and the second end includes a tubular outer surface of reduced size. The inner surface of coupling nut 16 includes internal threads 58 proximate second end 56, and a radially inwardly-extending collar 60 proximate first end 54.

Interface body 18 is substantially annular and includes a first end 70 and a second end 72. First end 70 is proximate a first annular body section 74 of relatively large internal diameter and second end 72 is located proximate second annular body section 76 which has a relatively smaller internal diameter than first annular body section 74. A third annular body section 78 is located intermediate first annular body section 74 and second annular body section 76 and has a relatively smaller internal diameter than second annular body section 76. Furthermore, the outer diameter of interface body 18 in the regions proximate first annular body section 74 and second annular body section 76 are essentially the same; however, they may vary under different embodiments. The outer diameter in the region proximate the third annular body section 78 is relatively larger than the outer diameter of first annular body section 74 and second annular body section 76.

Inner insulator 20 has a first end 82 and a second end 84. The outer diameter of inner insulator 20 is continuous, and sized to be received within the second end 72 of interface body 18. First end 82 includes an internal bore 86 sized to receive inner dielectric 28 of coaxial cable 32. A smaller bore 88 is axially aligned with bore 86, and extends from first end 82 to second end 84 of inner insulator 20. This bore is sized to receive male contact 14 therethrough. However, collar 45 of male contact 14 is larger than bore 88 and accordingly bears against the wall formed at the junction between bore 86 and bore 88, so that male contact 14 is secured in place.

During assembly, coaxial cable 32 must first be prepared by stripping the end of coaxial cable 32, so that only inner conductor 30 is remaining. Next, the outer insulator 24 is stripped off a small portion proximate the end, so that outer braided conducted 26 is visible. The end of coaxial cable 32 is then inserted through first end 34 of bushing 12, so that second end 36 of bushing 12 is proximate the end of coaxial cable 32 that is receiving connector 10. Inner conductor 30 is next inserted into first end 44 of male contact 14. A bore 49 is located in annular body 42 of male contact 14 and is adapted to receive solder, or the like, in order to secure inner conductor 30 within male contact 14.

Figure 1:
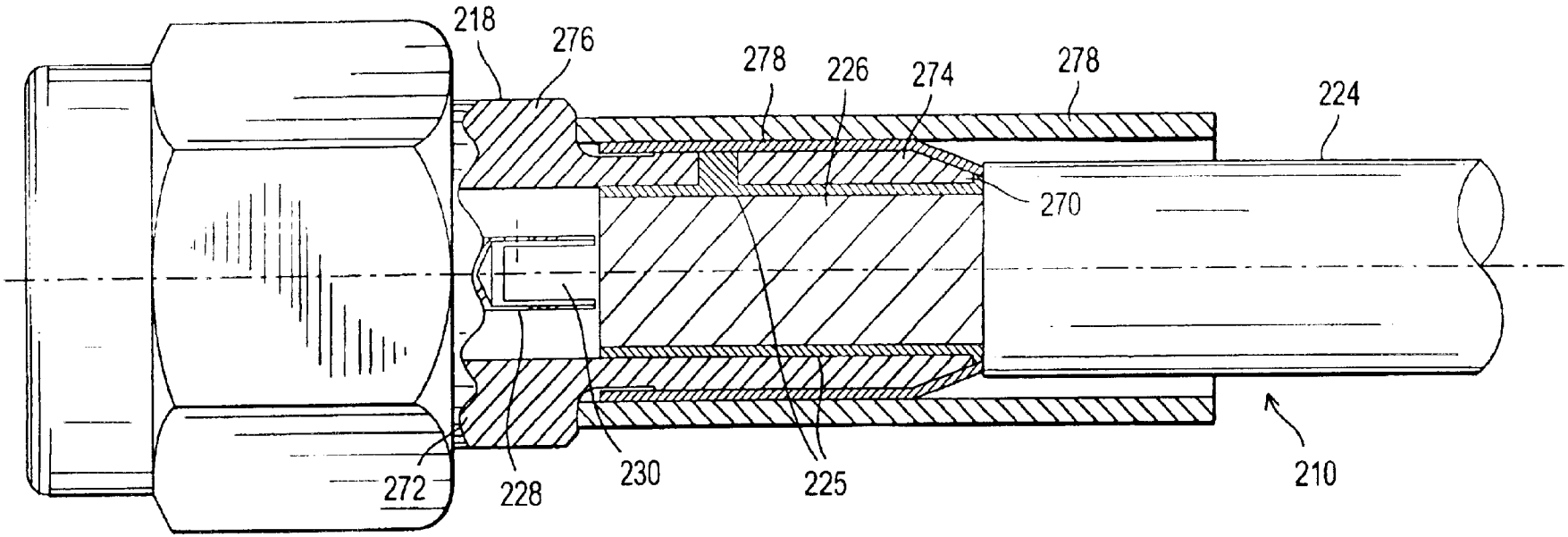
FIG. 1 PRIOR ART
FIG. 1 is a fully assembled cross-sectional view of an embodiment in accordance with the prior art.

The outer braided conductor 26 is next fanned in a radially outwardly-extending direction, as depicted in FIG. 1. The cable (with fanned outer conductor 26) is inserted through first end 54 of coupling nut 16 and first end 70 of interface body 18. Coupling nut 16 freely moves between collar 38 of bushing 12 and third annular body section 78 of interface body 18. The coaxial cable fits through first end 70 of interface body 18. The inner conductor 30 and inner insulator 28 fit through the bore formed in the third annular body section 78 of interface body 18; however, the fanned-out braid of outer conductor 26 will not fit through third annular section 76. Thus, coaxial cable 32 is only inserted to this point. Bushing 12 is then inserted into first end 54 of coupling nut 16 and first end 70 of interface body 18. This insertion is accomplished by machine or specially designed pincers, and ribs 40 bear against and frictionally engage the inner surface of first annular body section 74, to essentially lock bushing 12 within interface body 18. Upon complete insertion of bushing 12 within interface body 18, second end 36 of bushing 12 bears against the fanned-out braid of outer conductor 28 and against wall 81 of third annular body section 78. Accordingly, this locks coaxial cable 32 to connector 10, and creates electrical contact between outer conductor 26, bushing 12, coupling nut 16 and interface body 18. Next the first end of inner insulator 20 is inserted within second end of interface body 18, and accordingly, male contact 14 extends axially through bore 88 of inner conductor 20. A further gasket 22 is inserted within interface body 18 in the usual manner.

The locking of bushing 12 with interface body 18 rotationally couples coupling nut 16 to coaxial cable 32. This is most clearly seen in FIG. 2, where internally-extending collar 60 is locked between radially outwardly-extending collar 38 of bushing 12 and the outer wall of third annular body section 78 of interface body 18. A bonding agent 25 is applied to the surface of outer insulator 24 along where it engages bushing 12.

Significantly, outer insulator 24 is made of Teflon (a tetrafluoroethylene-hexafluoropropylene copolymer), which has an extremely low coefficient of friction and is almost completely inert to chemical attack and therefore must be preconditioned to accept a chemical bonding agent. Preconditioning is accomplished by treating outer insulator 24 with a sodium naphthalene solution (per ASTM D 2093) or by plasma etching. The etching process removes Teflon and leaves micro-porous voids on the outer surface of insulator 24.

The bonding agent which is applied to outer insulator 24 is a moderate viscosity, high flexural strength two part epoxy resin (or retaining compound) that cures rigid and is applied along the surface of insulator 24 using an applicator such as a syringe with a narrow gage dispenser tip to control volume and flow rate. The epoxy resin is preheated to approximately 150° F. to facilitate mixing and reduce the specific gravity. This enables the epoxy resin to fill the micro porous voids formed along insulator 24.

A sufficient volume of epoxy resin is injected to completely fill the void between outer insulator 24 and the inside surface of the bushing 12 of connector 10. This void is a small gap, typically 0.002" to 0.005", between the inner surface of the bushing 12 and the outside surface of outer insulatator 24. The particular epoxy resin selected as the bonding agent provides the strongest bond to surfaces that are separated less than 0.010". Suitable epoxy resins include a polyamide/epoxy resin of the epoxide chemical family and other well known industrial epoxy resins.

Various experimental configurations were conducted to optimize the area to be filled by the epoxy resin. Obviously, increasing gap distance resulted in a weaker bond between insulator 24 and bushing 12. Piercing insulator 24 to allow the epoxy resin to bond to outer braided conductor 26 causes the epoxy resin to wick up the inner surface of insulator 24 beyond the back end of connector 10. This excess epoxy resin fractured when cable 32 was bent and resulted in premature failure of the cable assembly. Adding cross holes to bushing 12 allowed the epoxy resin to flow into the attachment nut, causing it to bind.

The epoxy resin is cured by heating the assembly to 200° F. for two hours, which drives off the volatiles and forms a rigid, homogeneous bond between outer insulator 24 and bushing 12.

Figure 4:
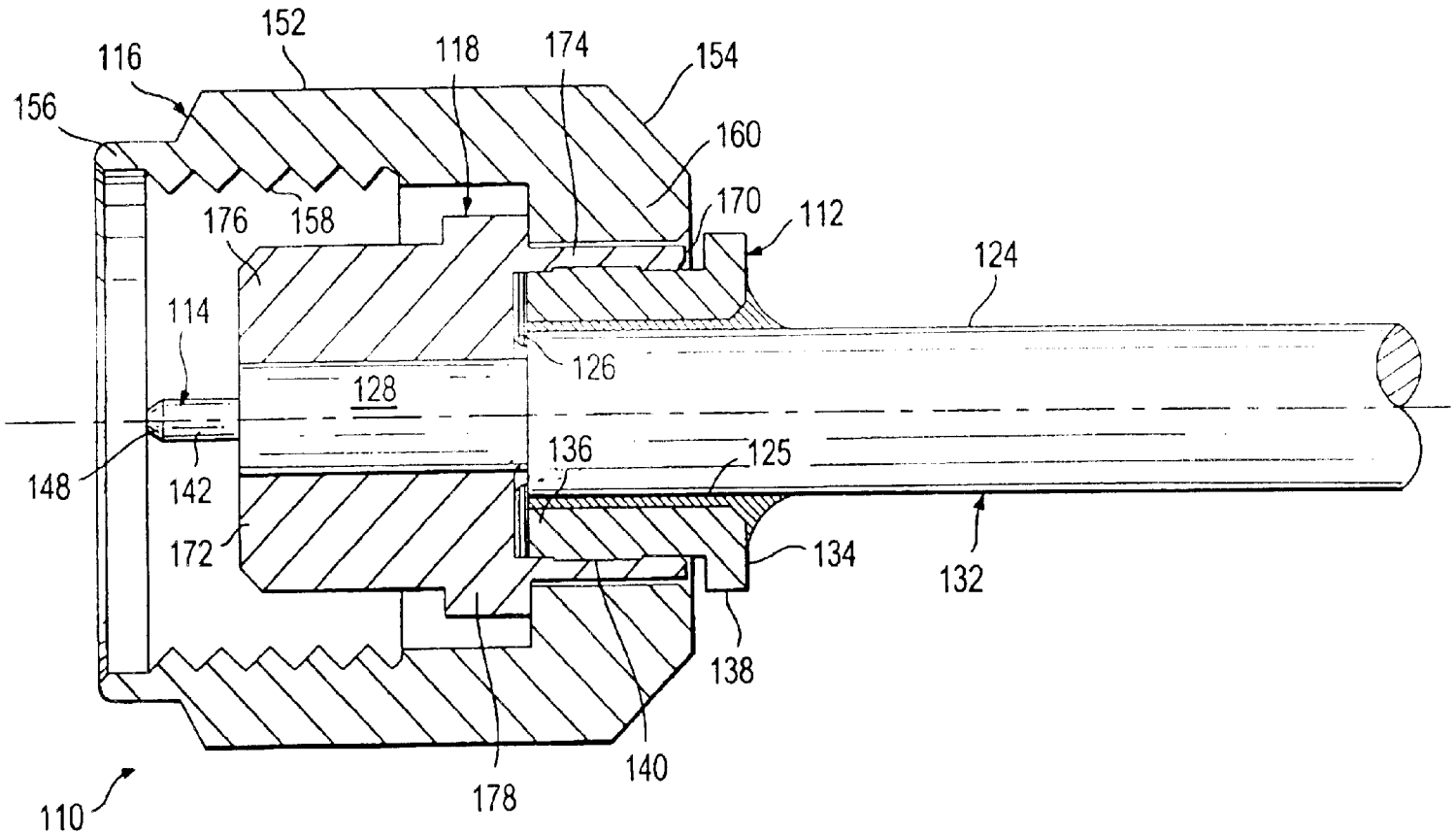
FIG. 4 is a fully-assembled cross-sectional view in accordance with the second embodiment of the present invention.

Reference is now made to FIG. 4 of the drawings wherein a second embodiment of an electrical connector, generally indicated at 110 and constructed in accordance with the invention, is depicted. Connector 110 includes a bushing 112, a male contact or inner conducter 114, a coupling nut 116, and an interface body 118.

Bushing or locking member 112 has a continuos inner diameter sized to tightly receive a bonding agent 125 disposed along outer insulator 124 of coaxial cable 132— cable 132 is the same as depicted in FIGS. 2 and 3. Bushing 112 includes a first end 134 and a second end 136. A radially-extending collar 138 extends from the first end 134 of bushing 112, and a plurality of axially-extending ribs 140 are located intermediate first end 134 and second end 136. Ribs 140 extend radially outward from the outer surface of bushing 112.

Male contact or inner conductor 114 includes an essentially annular body 142 which terminates in a cone-shaped member 148. This is an contrast to the embodiment of FIGS. 2–3, in which a male contact is placed over the inner conductor. Here the inner conductor 114 and male contact are one and the same.

Coupling nut 116 includes a first end 154 and a second end 156. First end 154 leads to a hexagonal outer surface 152, and second end 156 includes a tubular outer surface of reduced sized. The inner surface of coupling nut 116 includes internal threads 158 proximate second end 156, and a radially extending collar 160 proximate first end 154.

Interface body 118 is substantially annular and includes a first end 170 and a second end 172. First end 170 is proximate a first annular body section 174 of relatively large internal diameter and second end 172 is located proximate second annular body section 176 which has a relatively smaller internal diameter than first annular body section 174. A third annular body section 178 is located between sections 174 and 176 and has the same internal diameter as section 176.

As before, a bonding agent 125 is applied to the surface of insulator 124 along where it engages bushing 112.

The preferred embodiment of FIG. 3 permits the realization of a 65 GHz connector assembly. This connector assembly is matable with industry standard 1.85 mm and 2.4 mm interfaces. The center or inner conductor 114 of cable 132 substitutes silver-plated, copper clad steel for the silver-plated copper that is normally used. The connector assembly uses this center or inner conductor 114 of cable 132 as the center contact and dielectric 128 of cable 132 as the inner insulator. Interface body 118 is mechanically and electrically attached to outer braided conductor 126 (fanned out) of cable 132 in the same manner as the embodiment of FIGS. 1–2. The rigid epoxy bonding of outer insulator 124 to body 118 via bushing or locking member 112 eliminates any movement of inner conductor 114 and outer braided conductor 126 when electrical connector 110 is mated or demated. This allows the connector assembly to exhibit a repeatable electrical performance with successive mates and demates. Other captivation methods (clamping or crimping) would add significant length to the back end of the connector assembly, which is undesirable to the customer.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An microwave connector assembly comprising:

a terminating flexible microwave coaxial cable including an inner conductor, an intermediate dielectric, an outer flexible braided conductor, and an outer insulator;

a bored interface body having a first end with a first bore of relatively large inner diameter, a second end with a second bore of relatively smaller inner diameter than said first bore, and a third bore located therebetween of relatively smaller inner diameter than said second bore;

a coupling member proximate said interface body;

an annular locking member having an inside surface sized to receive said coaxial cable therein and bonded by means of a bonding agent to said outer insulator thereof, an outer diameter sized to fit tightly within said first bore of said interface body, a first end and a second end, said second end having a plurality of ribs disposed proximate thereto, so that upon insertion of said second end of said locking member within said first bore of said interface body, said ribs frictionally engage the inner wall of said first bore to lock said locking member to said interface body;

wherein said bonding agent is a high flexural strength rigid epoxy resin that eliminates movement between said coaxial cable and said annular locking element and provide a pull strength in excess of 10 pounds and antirotational captivation up to ±90 degrees for multiple mating and demating cycles.

2. The microwave connector assembly as claimed in claim 1 wherein a radially-inwardly extending wall exists at least partially between said first bore and said third bore of said bored interface body.

3. The microwave connector assembly as claimed in claim 2 wherein said locking member locks said coaxial cable within said interface body.

4. The microwave connector assembly as claimed in claim 2 wherein said locking member bears against said outer flexible braided conductor and urges same against said radially-inwardly extending wall.

5. The microwave connector assembly as claimed in claim 4 wherein said outer flexible braided conductor is electrically coupled to said coupling member.

6. The microwave connector assembly as claimed in claim 1, said coupling means comprising a nut having an internally threaded portion and an inwardly extending collar.

7. The microwave connector assembly as claimed in claim 6, said bored interface body having a radially outwardly-extending flange proximate said third bore.

8. The microwave connector assembly as claimed in claim 7 wherein said first end of said locking member includes an outwardly extending collar.

9. The microwave connector assembly as claimed in claim 8, wherein said inwardly extending collar of said coupling means is held captive between said outwardly-extended flange of said bored interface body and said collar of said locking means.

10. The microwave connector assembly as claimed in claim 9, wherein said coupling member is rotationally coupled to said coaxial cable.

11. The microwave connector assembly as claimed in claim 1, wherein said coupling member is rotationally coupled to said coaxial cable.

12. The microwave connector assembly as claimed in claim 1, further including a male contact for receiving said inner conductor and providing rigidity thereto.

13. The microwave connector assembly of claim 1, wherein said outer insulator is pre-conditioned in order to accept said bonding agent.

14. The assembly of claim 1, wherein said bonding agent is an epoxy resin.

15. The microwave connector assembly of claim 13, wherein said outer insulator is pre-conditioned to produce micro-porous voids for retaining said bonding agent.

16. A microwave connector assembly comprising:

a terminating flexible microwave coaxial cable including an inner conductor, an intermediate dielectric, an outer flexible braided conductor, and an outer insulator, constructed and arranged to conduct effectively electrical signals of at least 30 GHz;

a bored interface body having a first end with a first bore of relatively large inner diameter and a second end with a second bore of relatively smaller inner diameter adapted to receive said intermediate dielectric therein, and a radially inwardly extending wall formed between said first bore and said second bore;

a coupling member proximate said interface body; and an annular locking member having an inside surface sized to receive said outer insulator of said coaxial cable therein and bonded by means of a bonding agent to said outer insulator thereof, an outer diameter sized to fit tightly within said first bore of said interface body, a first end and a second end, said second end being insertable within said first end of said interface body and adapted to urge said outer flexible braided conductor against said wall to essentially lock said flexible coaxial cable to said connector;

wherein said bonding agent is a high flexural strength rigid epoxy resin that eliminates movement between said coaxial cable and said annular locking element and provide antirotational captiviation of up to ±90 degrees during repeated mating and demating cycles.

17. The microwave connector as claimed in claim 16 further including means for locking said annular locking member to said interface body.

18. The microwave connector as claimed in claim 17 wherein said locking means includes a plurality of radially outwardly extending ribs disposed on said locking member.

19. The microwave connector as claimed in claim 16, wherein said outer flexible braided conductor is electrically coupled to said coupling member.

20. The microwave connector as claimed in claim 16, wherein said coupling member comprises a nut having an internally threaded portion.

21. The microwave connector of claim 16, wherein said outer insulator is pre-conditioned to produce micro-porous voids for retaining said bonding agent.

22. The assembly of claim 16, wherein said bonding agent is an epoxy resin.

23. The microwave connector assembly of claim 13, wherein said outer insulator is pre-conditioned by one of treatment with a sodium naphthalene solution and plasma etching.

24. The microwave connector of claim 21, wherein said outer insulator is pre-conditioned by plasma etching.

25. A microwave connector assembly comprising:

a terminating flexible microwave coaxial cable including an inner conductor, an intermediate dielectric, an outer flexible braided conductor, and an outer insulator said microwave flexible coaxial cable being constructed and arranged to conduct signals in the microwave range that exceed 30 GHz;

a bored interface body having a first end with a first bore of relatively large inner diameter, a second end with a second bore of relatively smaller inner diameter than said first bore, and a third bore located therebetween of relatively smaller inner diameter than said second bore;

a coupling member proximate said interface body;

an annular locking member having an inside surface sized to receive said coaxial cable therein and bonded by means of an epoxy resin bonding agent to said outer insulator thereof, an outer diameter sized to fit tightly within said first bore of said interface body, a first end and a second end, said second end having a plurality of ribs disposed proximate thereto, so that upon insertion of said second end of said locking member within said first bore of said interface body, said ribs frictionally engage the inner wall of said first bore to lock said locking member to said interface body;

wherein said epoxy resin is a high flexural strength rigid epoxy resin that eliminates movement between said coaxial cable and said annular locking element and provides antirotational captivation of up to ±90 degrees during repeated mating and demating cycles.

26. The microwave connector of claim 25 wherein said epoxy resin is polyamide/epoxy resin of the epoxide chemical family.

27. A microwave connector assembly for connection to an electrical device, comprising:

a terminating flexible microwave coaxial cable including an inner conductor, an intermediate dielectric, an outer flexible braided conductor, and an outer insulator adapted to conduct microwave signals of at least 30 GHz;

a coupling nut adapted to connect said microwave flexible cable to the device; and an annular locking member having an inside surface sized to receive said outer insulator of said coaxial cable therein and bonded by means of a bonding agent to said outer insulator thereof, said annular locking member being coupled to said coupling nut;

wherein said bonding agent is a high flexural strength rigid epoxy resin that eliminates movement between said coaxial cable and said annular locking element and provides antirotational captivation during mating and demating cycles.

* * * * *